US008433232B2

(12) United States Patent
Fujii

(10) Patent No.: US 8,433,232 B2
(45) Date of Patent: Apr. 30, 2013

(54) IMAGE FORMING SYSTEM, IMAGE FORMING APPARATUS, TRANSPORTATION AMOUNT ADJUSTING METHOD AND COMPUTER READABLE MEDIUM

(75) Inventor: Daisuke Fujii, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 280 days.

(21) Appl. No.: 12/868,411

(22) Filed: Aug. 25, 2010

(65) Prior Publication Data

US 2011/0236111 A1 Sep. 29, 2011

(30) Foreign Application Priority Data

Mar. 29, 2010 (JP) ..... 2010-075725

(51) Int. Cl.
*G03G 15/00* (2006.01)

(52) U.S. Cl.
USPC ..... 399/384; 399/19

(58) Field of Classification Search ..... 399/384, 399/16, 18, 19
See application file for complete search history.

(56) References Cited

U.S. PATENT DOCUMENTS

| | | | | |
|---|---|---|---|---|
| 4,774,524 | A * | 9/1988 | Warbus et al. | 346/44 |
| 5,548,390 | A | 8/1996 | Sugisaki et al. | |
| 7,337,936 | B2 * | 3/2008 | Ishida et al. | 226/143 |
| 7,444,114 | B2 * | 10/2008 | Tanimoto | 399/396 |

FOREIGN PATENT DOCUMENTS

| | | | |
|---|---|---|---|
| JP | 07-237336 | A | 9/1995 |
| JP | 11-314421 | A | 11/1999 |
| JP | 2006-153999 | A | 6/2006 |

* cited by examiner

*Primary Examiner* — Judy Nguyen
*Assistant Examiner* — Justin Olamit
(74) *Attorney, Agent, or Firm* — Sughrue Mion, PLLC

(57) ABSTRACT

An image forming system includes: first and second image forming units that respectively form images on first and second surfaces of a recording medium formed into a belt shape while transporting the recording medium spanning the first and second image forming units; first and second transportation controllers that control a pre-transportation operation performed from a transportation start of the recording medium to arrival at a predetermined transportation speed, and a post-transportation operation including return transportation of the recording medium to an upstream side in a transporting direction performed from a start of a transportation stop to a stop of the recording medium; and a recording medium amount setting unit that adjusts transportation amounts of the recording medium in the pre-transportation and post-transportation operations, and thereby sets a recording medium amount existing between the first and second image forming units to a predetermined recording medium amount after the transportation stop.

7 Claims, 11 Drawing Sheets

IMAGE FORMING SYSTEM, IMAGE FORMING APPARATUS, TRANSPORTATION AMOUNT ADJUSTING METHOD AND COMPUTER READABLE MEDIUM

CROSS REFERENCE TO RELATED APPLICATIONS

This application is based on and claims priority under 35 USC §119 from Japanese Patent Application No. 2010-75725 filed Mar. 29, 2010.

BACKGROUND

1. Technical Field

The present invention relates to an image forming system, an image forming apparatus, a transportation amount adjusting method and a computer readable medium storing a program.

2. Related Art

There is known an image forming system that continuously forms images in the following manner on both sides of continuous paper being a recording medium formed into a belt shape. In this image forming system, the continuous paper is transported while being spanned by a first image forming apparatus and a second image forming apparatus arranged on the downstream side of the first image forming apparatus in a transportation route, the first image forming apparatus forms an image on a first surface, and the second image forming apparatus forms an image on a second surface.

SUMMARY

According to an aspect of the present invention, there is provided an image forming system including: a first image forming unit that forms an image on a first surface of a recording medium formed into a belt shape; a second image forming unit that is arranged on a downstream side with respect to the first image forming unit in a transporting direction of the recording medium, and that forms an image on a second surface of the recording medium while transporting the recording medium spanning the first image forming unit and the second image forming unit; a first transportation controller that controls a transportation operation of the recording medium including a pre-transportation operation and a post-transportation operation in the first image forming unit, the pre-transportation operation being performed from a transportation start of the recording medium to a time point after arrival at a predetermined transportation speed, the post-transportation operation including return transportation of the recording medium to an upstream side in the transporting direction performed from a start of a transportation stop to a stop of the recording medium; a second transportation controller that controls a transportation operation of the recording medium including a pre-transportation operation and a post-transportation operation in the second image forming unit, the pre-transportation operation being performed from a transportation start of the recording medium to a time point after arrival at a predetermined transportation speed, the post-transportation operation including return transportation of the recording medium to the upstream side in the transporting direction performed from a start of a transportation stop to a stop of the recording medium; and a recording medium amount setting unit that adjusts at least any one of a transportation amount of the recording medium in the pre-transportation operation and the post-transportation operation controlled by the first transportation controller and a transportation amount of the recording medium in the pre-transportation operation and the post-transportation operation controlled by the second transportation controller, and thereby sets a recording medium amount to a predetermined recording medium amount after the transportation stop of the recording medium, the recording medium amount being set to exist between the first image forming unit and the second image forming unit.

BRIEF DESCRIPTION OF THE DRAWINGS

Exemplary embodiment(s) of the present invention will be described in detail based on the following figures, wherein:

FIG. 6-1 is a flowchart showing contents of the transportation control, concerning the continuous paper, performed in the second printer;

FIG. 6-2 is a flowchart showing contents of the transportation control, concerning the continuous paper, performed in the second printer;

DETAILED DESCRIPTION

An exemplary embodiment of the present invention will be described below in detail with reference to the accompanying drawings.

Description of Image Forming System

Figure 1:
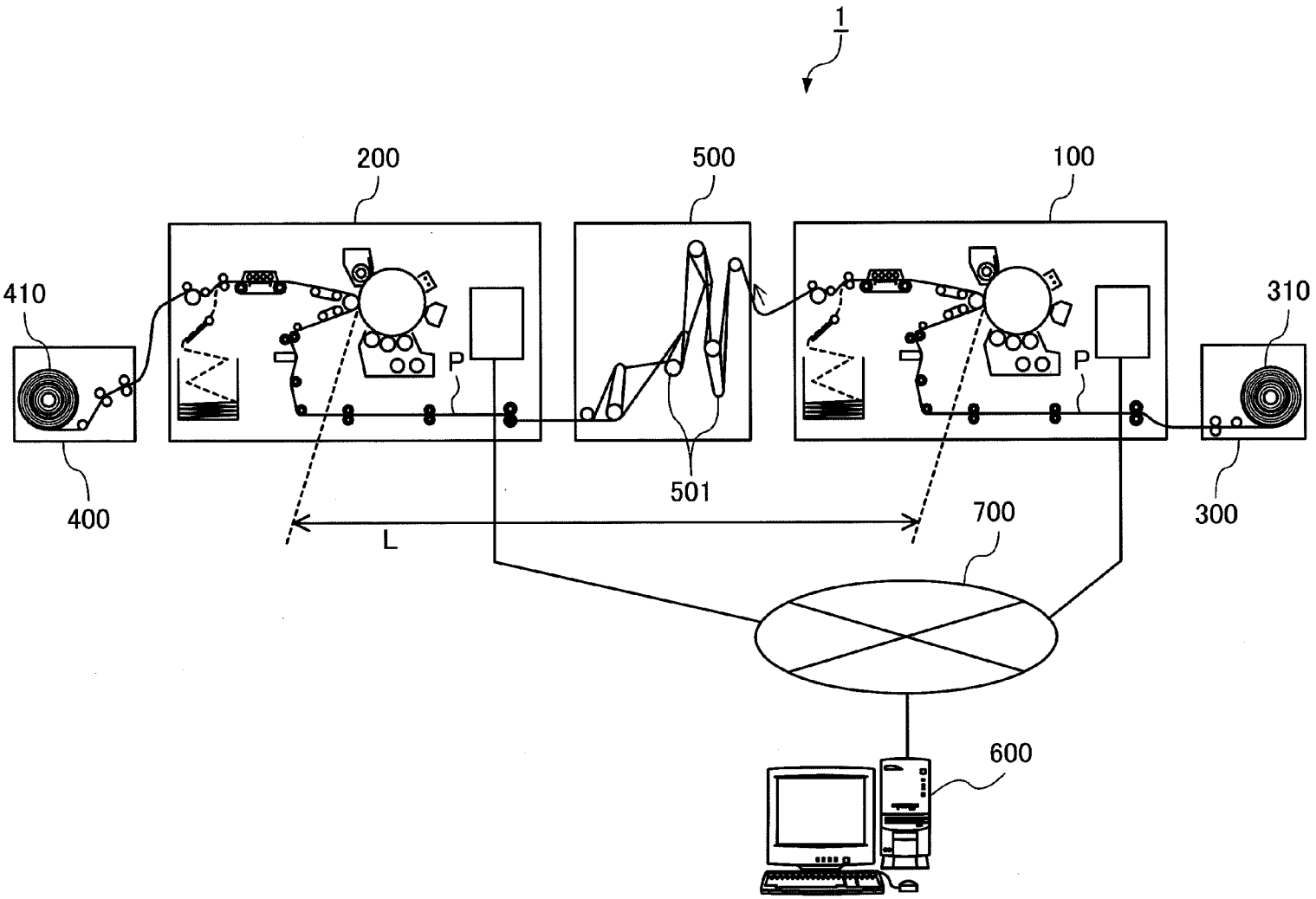
FIG. 1 is a diagram showing an overall configuration of an image forming system according to the present exemplary embodiment.

FIG. 1 is a diagram showing an overall configuration of an image forming system 1 according to the present exemplary embodiment. The image forming system 1 shown in FIG. 1 is configured by so-called two "continuous feed printers," as image forming apparatuses, connected with each other. Each of the continuous feed printers forms images on continuous paper P that is a recording medium formed into a belt shape.

From the upstream side of a transportation route of the continuous paper P toward the downstream side thereof, the image forming system 1 includes: a continuous paper feeder 300 feeding the continuous paper P; a first printer 100 serving as an example of a first image forming unit (a first image forming apparatus or an image forming apparatus) arranged on the upstream side; an intermediate unit 500 reversing front and back surfaces of the continuous paper P; a second printer 200 serving as an example of a second image forming unit (a second image forming apparatus or an image forming apparatus) arranged on the downstream side in a transporting direction; and a continuous paper winder 400 winding up the continuous paper P.

Additionally, the image forming system 1 according to the present exemplary embodiment includes a control computer 600 serving as an example of a controller (a control device) that controls operations of the first printer 100 and the second printer 200. The control computer 600 is connected to the first printer 100 and the second printer 200 through a communication network 700 serving as an example of a communication unit.

The continuous paper feeder 300 includes a continuous paper roll 310 installed therein, and feeds the continuous paper P to the first printer 100.

The first printer 100 forms an image on the front surface (a first surface) of the continuous paper P fed from the continuous paper feeder 300, on the basis of image data transmitted from the control computer 600. Additionally, prior to the image formation, the first printer 100 prints: a page registration mark (ROF) for positioning of an image generated by the first printer 100 and an image generated by the second printer 200; and a page identification mark (ID) for identifying a page on the continuous paper P (to be described later).

The intermediate unit 500 reverses the front and back surfaces of the continuous paper P and feeds the continuous paper P to the second printer 200. Specifically, the intermediate unit 500 is provided with a front-back reverse roll 501 arranged with inclination of 45 degrees with respect to the transporting direction of the continuous paper P, and transports the continuous paper P while hanging the continuous paper P on the front-back reverse roll 501, thereby to reverse the front and back surfaces of the continuous paper P. Additionally, the intermediate unit 500 forms a loop to hold the continuous paper P, and has a buffer function to inhibit large variation of tension on the continuous paper P by varying a loop amount of the continuous paper P. This buffer function inhibits, between the first printer 100 and the second printer 200, tear of the continuous paper P caused by excessively increased tension on the continuous paper P, or displacement in the transporting direction of the continuous paper P and wrinkles in the continuous paper P caused by looseness of the continuous paper P.

The second printer 200 is configured similarly to the first printer 100. The second printer 200 prints an image on the back surface (a second surface) of the continuous paper P of which the first printer 100 has performed the print processing on the front surface, on the basis of image data transmitted from the control computer 600.

The continuous paper winder 400 winds, around a winding roll 410, the continuous paper P of which the second printer 200 has performed the print processing on the back surface.

The control computer 600 outputs the image data with which the image formation is to be performed on the front surface (the first surface) and the image data with which the image formation is to be performed on the back surface (the second surface), at predetermined timing to the first printer 100 and the second printer 200, respectively, through the communication network 700. Additionally, the control computer 600 outputs control signals that control operations of the first printer 100 and the second printer 200. The control computer 600 functions as a recording medium amount setting unit that sets, to a predetermined paper amount, a path length setting value L (a recording medium amount) at the time when the image formation processing is interrupted or the image formation is finished, which will be described later.

The communication network 700 is configured so as to be interactively communicable by using a communication line and a cable, and is configured by, for example, a network such as LAN (Local Area Network), WAN (Wide Area Network) or the like.

Description of Operations of Image Forming System

In the image forming system 1 according to the present exemplary embodiment, under the control of the control computer 600, the first printer 100 forms an image on the front surface of the continuous paper P fed from the continuous paper feeder 300. The continuous paper P of which the first printer 100 has formed the image on the front surface is transported to the intermediate unit 500. The intermediate unit 500 reverses the front and back surfaces of the transported continuous paper P, and transports the continuous paper P to the second printer 200. The second printer 200 to which the reversed continuous paper P has been transported forms an image on the back surface of the continuous paper P. The continuous paper P of which the images are thus formed on the both surfaces is transported to the continuous paper winder 400, and is wound around the winding roll 410.

In the image forming system 1 according to the present exemplary embodiment, the first printer 100 forms the image on the front surface of the continuous paper P, and the second printer 200 forms the image on the back surface of the continuous paper P. However, the image forming system 1 may be configured so that the first printer 100 forms the image on the back surface of the continuous paper P and the second printer 200 forms the image on the front surface of the continuous paper P.

Description of Printers

Next, a description is given of a configuration of the first printer 100 and the second printer 200 according to the present exemplary embodiment.

Figure 2:
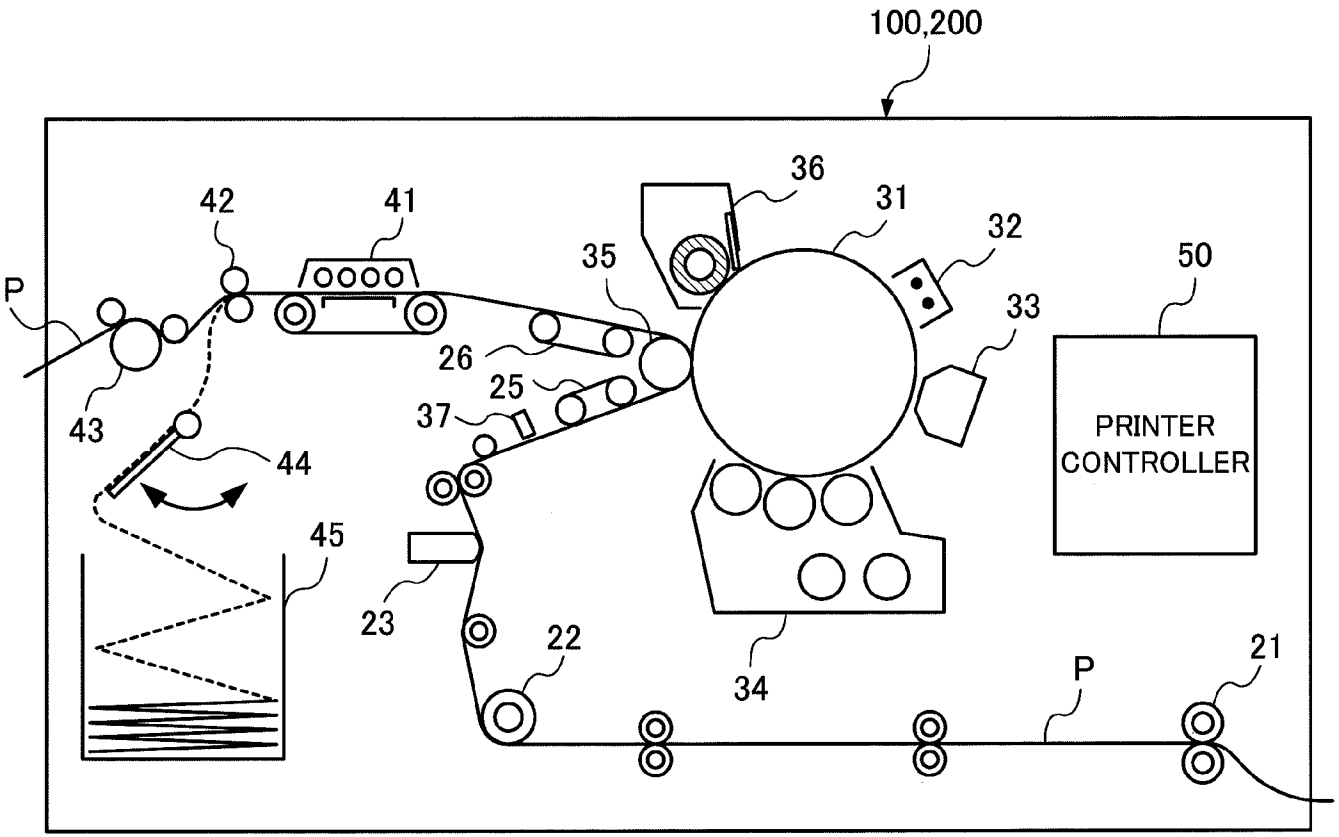
FIG. 2 is a diagram showing the configuration of the first printer and the second printer according to the present exemplary embodiment.

FIG. 2 is a diagram showing the configuration of the first printer 100 and the second printer 200 according to the present exemplary embodiment. As shown in FIG. 2, the first printer 100 and the second printer 200 are image forming apparatuses of an electrophotographic type, for example. As an image forming function unit, the first printer 100 and the second printer 200 each include: a photoconductive drum 31 as an image carrier; a charging device 32 that charges the surface of the photoconductive drum 31 with a predetermined potential; and an exposure device 33 that exposes the surface of the photoconductive drum 31 on the basis of image data. Furthermore, the first printer 100 and the second printer 200 each include: a developing device 34 that develops an electrostatic latent image formed on the surface of the photoconductive drum 31 with toner; a transfer roll 35 that transfers a toner image formed on the surface of the photoconductive drum 31 to the continuous paper P; a cleaner 36 that removes residual toner on the surface of the photoconductive drum 31; and a flash fixing device 41 that fixes the toner image formed on the continuous paper P by flashing.

As a feed transportation system forming a part of a transportation unit, the first printer 100 and the second printer 200 each include: transport rolls 21 that transport, to the inside of the printer, the continuous paper P from the continuous paper feeder 300; a drive roll 22 that receives drive from a drive motor (not shown) to rotate; a tension application member 23 that applies tension to the continuous paper P transported to the transfer roll 35; a transportation belt member 25 that is arranged on the upstream side of the transfer roll 35 and transports the continuous paper P to the transfer roll 35; and a transportation belt member 26 that is arranged on the downstream side of the transfer roll 35 and transports the continuous paper P from the transfer roll 35. Additionally, as an exit transportation system forming a part of the transportation unit, the first printer 100 and the second printer 200 each include: tension application roll members 42 that apply tension to the continuous paper P; and a tension roll 43 that nips the continuous paper P in the vicinity of an exit and rotates at a circumferential speed faster than the transportation speed of the continuous paper P so as to apply the tension to the continuous paper P. Moreover, the first printer 100 and the second printer 200 each include a continuous paper accumulation member 44 that accumulates the continuous paper P to a container 45 on the occasion of simplex printing on the continuous paper P, while swinging the continuous paper P laterally.

Furthermore, the first printer 100 and the second printer 200 each include a printer controller 50 that controls the overall operation of the printer. The printer controllers 50 respectively arranged in the first printer 100 and the second printer 200 are connected to the control computer 600 through the communication network 700.

Additionally, the second printer 200 includes an image reading sensor 37 that reads the page registration mark (ROF) and the page identification mark (ID) generated by the first printer 100, at a position along the transportation route of the continuous paper P on the upstream side of the transfer roll 35. For example, a line CCD (Charge Coupled Device) is used as the image reading sensor 37.

Description of Operation of Each Printer

In the first printer 100 and the second printer 200 according to the present exemplary embodiment, when the image forming system 1 is started, image data is inputted from the control computer 600 to each of the printer controllers 50 through the communication network 700. Each of the printer controllers 50 performs various kinds of image processing on the inputted image data, and outputs the image data to the exposure device 33.

In accordance with the input of the image data to each of the printer controllers 50, the printer controller 50 controls a paper transporting operation to transport the continuous paper P at a predetermined transportation speed while applying tension to the continuous paper P.

The first printer 100 and the second printer 200 then form toner images under the control of the respective printer controllers 50. Specifically, in each of the first printer 100 and the second printer 200, the photoconductive drum 31 starts rotating, and the surface of the photoconductive drum 31 is charged by the charging device 32 at a predetermined potential (for example, −500 V). Further, an electrostatic latent image corresponding to the image data is formed by the exposure device 33. The developing device 34 then develops the electrostatic latent image on the photoconductive drum 31 with toner, thereby to form a toner image. The toner image formed on the surface of the photoconductive drum 31 is transferred to the continuous paper P by the transfer roll 35. After that, the continuous paper P on which the toner image is formed is transported to the flash fixing device 41, and then the toner image is fixed on the continuous paper P. Thereby, an image is formed on the front surface side of the continuous paper P.

In the second printer 200, the start timing of the formation of a toner image is set so as to delay by the transportation time of the continuous paper P from the first printer 100 to the second printer 200. However, the start timing of the transportation of the continuous paper P is set so as to coincide with that of the first printer 100.

Description of Image Positioning Between Printers and Page Recognition

As described above, prior to the image formation on the basis of image data, the first printer 100 on the upstream side forms, on the continuous paper P, the page registration mark (ROF) used as a reference for positioning of an image generated by the first printer 100 and an image generated by the second printer 200, and the page identification mark (ID) for identifying a page on the continuous paper P.

Figure 3:
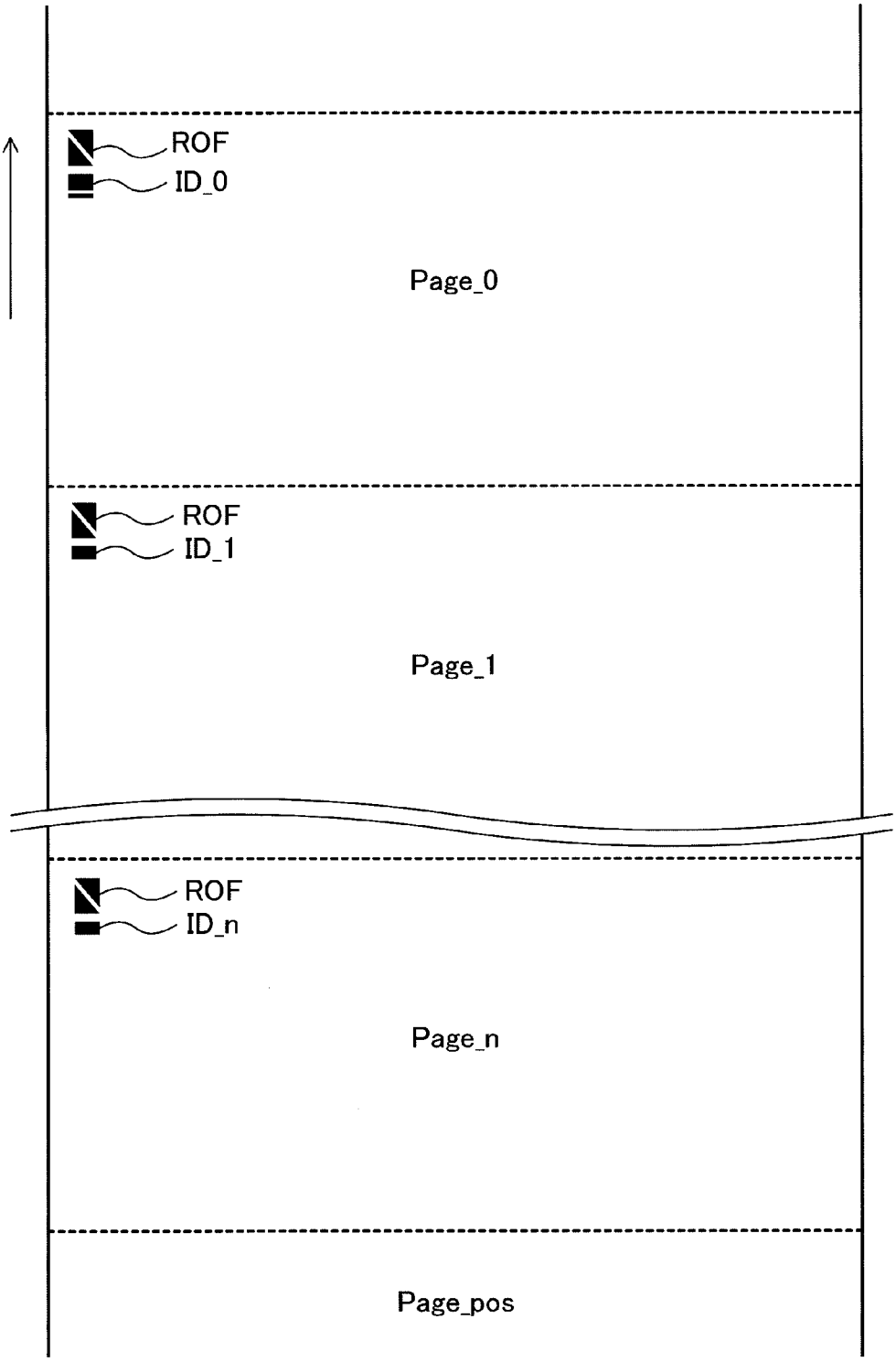
FIG. 3 is a diagram showing an example of the page registration marks and the page identification marks formed by the first printer.

FIG. 3 is a diagram showing an example of the page registration marks (ROF) and the page identification marks (ID) formed by the first printer 100. As shown in FIG. 3, the first printer 100 forms the page registration mark (ROF) and the page identification mark (ID_0) indicating that the next page is the first page (Page_1), on a page (Page_0) that is one page before the first page (Page_1) on which the image formation is performed. Then, the first printer 100 sequentially forms the page registration marks (ROF) and the page identification marks (ID_1 to ID_n) for identifying each page number, from the first page (Page_1) to the last page (Page_n), on the downstream side in the transporting direction (a direction of an arrow in FIG. 3) with respect to an image region in each page.

When the image formation up to the last page (Page_n) is finished, the first printer 100 transports empty pages (Page_pos) until the last page (Page_n) formed by the first printer 100 reaches the second printer 200.

In the second printer 200, the image reading sensor 37 reads the page registration mark (ROF) and the page identification mark (ID) of each page. Then, the printer controller 50 of the second printer 200 performs positioning with respect to the image formed by the first printer 100 for each page, on the basis of the page registration mark (ROF) read by the image reading sensor 37.

Additionally, the printer controller 50 of the second printer 200 recognizes the first page of the image formed by the first printer 100, on the basis of the page identification mark (ID) read by the image reading sensor 37. The printer controller 50 of the second printer 200 further determines an image formation completion page in the first printer 100. Specifically, the printer controller 50 of the second printer 200 recognizes the page identification mark (ID_0) indicating the first page of the image formed by the first printer 100, and thereby recognizes that the next page (Page_1) of the page from which the page identification mark (ID_0) is read is the first page. The printer controller 50 of the second printer 200 then makes the image formation started from the next page (Page_1). Additionally, if the image formation is interrupted in the image forming system 1 and then restarted, for example, the printer controller 50 of the second printer 200 determines the page (the image formation completion page) at which the image formation on the front surface in the first printer 100 has already completed, and determines the image of the back surface to be paired with that of the front surface on the image formation completion page.

The second printer 200 transports empty pages until the first page of the image formed by the first printer 100 reaches the second printer 200.

Description of Transportation Control on Continuous Paper in Each Printer

In the image forming system 1 according to the present exemplary embodiment, the control computer 600, the printer controller 50 of the first printer 100 (hereinafter, referred to as "a printer controller 50A") and the printer controller 50 of the second printer 200 (hereinafter, referred to as "a printer controller 50B") cooperate to perform transportation control of the continuous paper P.

Figure 4:
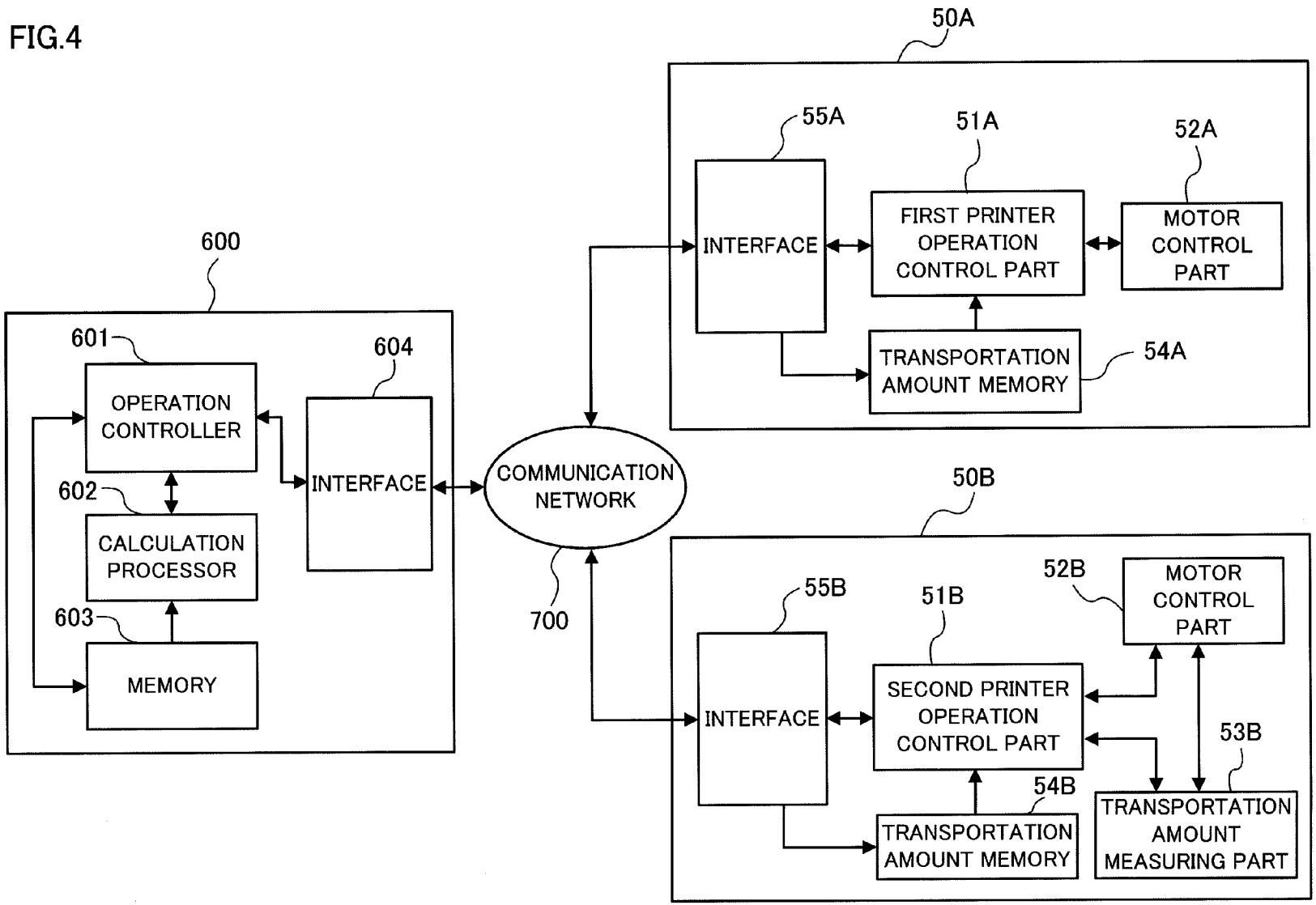
FIG. 4 is a diagram showing a configuration of functional units related to the transportation control of the continuous paper in the control computer and the printer controllers of the first printer and the second printer.

FIG. 4 is a diagram showing a configuration of functional units related to the transportation control of the continuous paper P in the control computer 600 and the printer controllers 50A and 50B of the first printer 100 and the second printer 200. As shown in FIG. 4, the control computer 600 includes: an operation controller 601 that performs an overall control on the operation of the transportation system (the feed transportation system and the exit transportation system) transporting the continuous paper P in the first printer 100 and the second printer 200; a calculation processor 602 serving as an example of a calculation unit that performs calculation processing concerning the transportation control; a memory 603 that stores information on a transportation amount of the continuous paper P in each of the first printer 100 and the second printer 200; and an interface 604 that controls transmission and reception of signals to and from the printer controllers 50A and 50B through the communication network 700.

The printer controller 50A of the first printer 100 serves as an example of a first transportation controller, and includes: a first printer operation control part 51A that controls an operation of the transportation system of the first printer 100; and a motor control part 52A that controls an operation of the drive motor (not shown) arranged in the first printer 100. Furthermore, the printer controller 50A includes: a transportation amount memory 54A serving as an example of a memory that stores information on the transportation amount of the continuous paper P transmitted from the control computer 600; and an interface 55A that controls transmission and reception of signals to and from the control computer 600 through the communication network 700.

The printer controller 50B of the second printer 200 serves as an example of a second transportation controller (a transportation controller), and includes: a second printer operation control part 51B that controls an operation of the transportation system of the second printer 200; a motor control part 52B that controls an operation of the drive motor (not shown) arranged in the second printer 200; and a transportation amount measuring part 53B serving as an example of a transportation amount measuring unit that measures the transportation amount of the continuous paper P in the second printer 200. Furthermore, the printer controller 50B includes: a transportation amount memory 54B serving as an example of a memory that stores information on the transportation amount of the continuous paper P measured by the transportation amount measuring part 53B; and an interface 55B that controls transmission and reception of signals to and from the control computer 600 through the communication network 700.

In the image forming system 1 according to the present exemplary embodiment, the transportation amount measuring part 53B of the printer controller 50B measures, for example, operation speeds of the respective drive motors and operation time with the respective operation speeds in the first printer 100 and the second printer 200. Thereby, the transportation amount measuring part 53B always monitors the transportation amounts of the continuous paper P (values respectively obtained by integrating the operation speeds with the operation time) in the first printer 100 and the second printer 200. Additionally, the printer controller 50B of the second printer 200 transmits the information on the transportation amounts of the continuous paper P to the control computer 600. The control computer 600 then adjusts the transporting operations in the first printer 100 and the second printer 200, on the basis of the transportation amounts of the continuous paper P transmitted from the second printer 200.

Here, each of the printer controllers 50A and 50B includes a CPU, a RAM, a ROM, a non-volatile memory and an interface (the interface 55A or 55B). The CPU executes digital calculation processing in accordance with a predetermined processing program, for controlling the operation of the transportation system in the first printer 100 or the second printer 200. The RAM is used as a working memory or the like for the CPU. The ROM stores therein various setting values used in the processing in the CPU. The non-volatile memory, such as a flash memory, is rewritable, is capable of holding data even when power supply is stopped, and is backed up by a battery. The interface controls input and output of signals from and to the control computer 600 and the like connected to the printer controller 50A or 50B. The CPU reads the processing program from an external storage (not shown), loads it into a main memory (the RAM), and thereby achieves functions of the functional units in the printer controller 50A or 50B.

As another provision method on this processing program, the program may be provided in a state where being prestored in the ROM, and be loaded into the RAM. In addition, when an apparatus includes a rewritable ROM such as an EEPROM, only this program may be installed in the ROM after setting of the CPU is made, and then be loaded into the RAM. Moreover, this program may also be transmitted to the printer controller 50A or 50B through a network such as the Internet, then installed in the ROM of the printer controller 50A or 50B, and further loaded into the RAM. Furthermore, the program may be loaded into the RAM from an external recording medium such as a DVD-ROM, a flash memory or the like.

Description of Transportation Sequence of Continuous Paper in First Printer and Second Printer Here, suppose that the image formation processing is interrupted due to occurrence of some trouble requiring the image formation processing to stop in the image forming system 1, and that thereafter the image formation processing is restarted. A transportation sequence of the continuous paper P in the first printer 100 and the second printer 200 on this occasion is now described.

Figure 5:
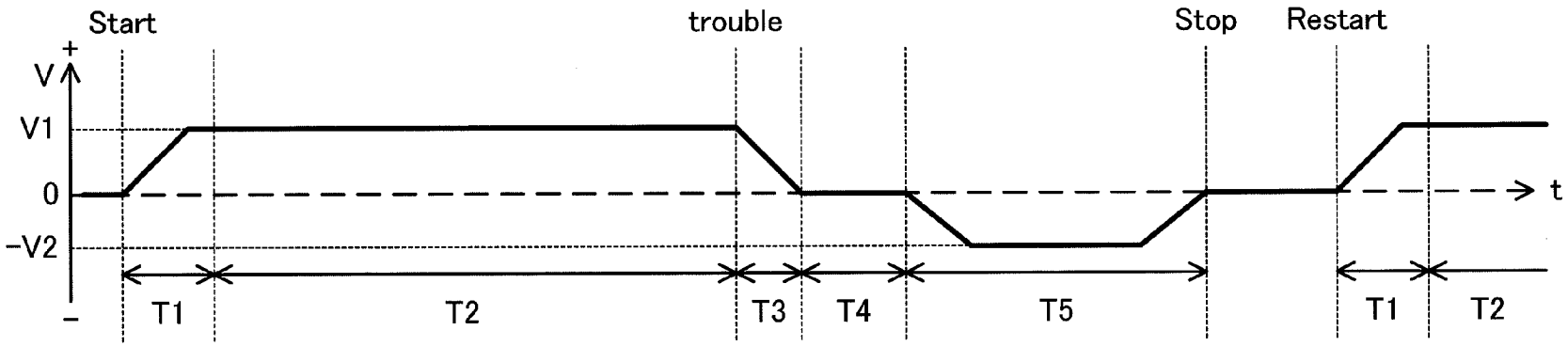
FIG. 5 is a diagram for illustrating the transportation sequence of the continuous paper in the first printer and the second printer.

FIG. 5 is a diagram for illustrating the transportation sequence of the continuous paper P in the first printer 100 and the second printer 200. In FIG. 5, the vertical axis is a transportation speed V of the continuous paper P, and the horizontal axis is transportation time t of the continuous paper P from the start of the image formation processing.

As shown in FIG. 5, when the image formation processing is started in the image forming system 1 (Start), transportation of the continuous paper P is started. At this time, a period (T1:

hereinafter, referred to as "a pre-transportation period") during which "a pre-transportation operation" (hereinafter, referred to as "pre-transportation") is performed is set. Here, the pre-transportation is performed until the transportation speed reaches a setting value V0 (0) and the image formation processing (for example, transfer processing of a toner image to the continuous paper P) is started in the image forming function unit. The pre-transportation period is a period set for transferring a toner image to the continuous paper P after the transportation speed V of the continuous paper P reaches a stable state (the setting value V0). Then, in the first printer 100 and the second printer 200, a toner image on the photoconductive drum 31 is formed so that the toner image reaches an arrangement position of the transfer roll 35 after the transportation speed V of the continuous paper P reaches the stable state (the setting value V0). That is, the toner image formed on the photoconductive drum 31 starts its arrival to the arrangement position of the transfer roll 35 the pre-transportation period T1 after the image formation processing is started. Then, the transfer of the toner image to the continuous paper P is performed (an image formation period: a period T2).

In this image formation period (the period T2), the first printer 100 forms: a pre-page (Page_0 in FIG. 3) including the page registration mark (ROF) and the page identification mark (ID_0) indicating that the next page is the first page; and pages starting from the first page (Page_1) each including an image of the front surface based on the subsequent image data. Additionally, the second printer 200 performs search processing to search the pre-page on which the page identification mark (ID_0) is formed, and forms pages starting from the first page (Page_1) each including an image of the back surface based on the subsequent image data.

In this state, suppose that some trouble requiring the image formation processing to stop, such as toner shortage in the developing device 34 of either the first printer 100 or the second printer 200, for example, (trouble) has occurred the period T2 after the elapse of the pre-transportation period T1. Then, the image formation processing in the image forming system 1 is interrupted, and "a post-transportation operation" (hereinafter, referred to as "post-transportation") to stop the continuous paper P is performed. This post-transportation operation is performed in a period including: a forward period (transportation speed=+V1 to 0) for a period T3 from the start of the post-transportation; a pause period (transportation speed=0) for a period T4; and a backward period (transportation speed=0 to −V2) for a period T5 (>T3). That is, the continuous paper P is stopped (Stop) after the period (T3+T4+T5) from the start of the transportation stop of the continuous paper P. Note that the continuous paper P is transported to the downstream side in the transporting direction in the forward period, while the continuous paper P is transported to the upstream side in the transporting direction (return transportation) in the backward period.

In the period (T3+T4+T5: hereinafter, referred to as "a post-transportation period") during which the post-transportation is performed, the continuous paper P is transported in the opposite direction (return transportation) so that the continuous paper P goes back for a paper transportation amount in the pre-transportation period T1, taking into consideration that another pre-transportation period T1 similar to the pre-transportation period T1 at the start time of the image formation processing (Start) will be set when the image formation processing is restarted next (Restart). Thereby, when the image formation processing is restarted, the image formation is started again from the position at which the interruption has occurred. This reduces occurrence of a problem, such as missing of images before and after the interruption, and generating a wasteful part of paper due to performing new image formation again from the head of a page.

Note that transportation of the continuous paper P in the first printer 100 is controlled by the first printer operation control part 51A of the printer controller 50A according to the transportation sequence of the continuous paper P described above, on the basis of the transportation amount of the continuous paper P (a value obtained by integrating the transportation speed V with the transportation time t) measured by the transportation amount measuring part 53B. Transportation of the continuous paper P in the second printer 200 is controlled by the second printer operation control part 51B of the printer controller 50B according to the transportation sequence of the continuous paper P described above, on the basis of the transportation amount of the continuous paper P measured by the transportation amount measuring part 53B.

Description of Path Length Setting Value

In the transportation control in the first printer 100 and the second printer 200 according to the transportation sequence described above, a continuous paper transportation amount set in the pre-transportation period T1 and the post-transportation period (T3+T4+T5) is generally fixed regardless of the size of image data length that sets the paper length (the length in the transporting direction) allocated to one page. For this reason, when the image formation processing is interrupted or the image formation is finished, the continuous paper P stops at the same position in a page in both of the first printer 100 and the second printer 200. Accordingly, a paper amount of the continuous paper P (hereinafter, referred to as "a path length setting value": "L" shown in FIG. 1) that actually exists on the transportation route from the arrangement position of the transfer roll 35 of the first printer 100 to that of the transfer roll 35 of the second printer 200 is an integral multiple of the paper length (the length of an image region and a margin) allocated to one page according to the image data length.

For example, suppose that a preset paper amount (a defined paper amount) between the first printer 100 and the second printer 200 is 500 inches. If the paper length of one page allocated according to the image data length is 3 inches, the path length setting value L is controlled so as to be 501 inches (the minimum paper amount that is not less than the defined paper amount 500 inches and is an integral multiple of 3 inches) corresponding to 3 inches×167 pages. On the other hand, if the paper length of one page allocated according to the image data length is 60 inches, the path length setting value L is controlled so as to be 540 inches (the minimum paper amount that is not less than the defined paper amount 500 inches and is an integral multiple of 60 inches) corresponding to 60 inches×9 pages.

Accordingly, a large difference of the paper amount (a difference of the recording medium amount) of 540−501=39 inches (·99 cm) is generated between the cases where the paper length of one page allocated according to the image data length is 3 inches and 60 inches, respectively. For this reason, in general, an intermediate apparatus (for example, the intermediate unit 500 of the present exemplary embodiment) having a buffer function is provided between the first printer 100 and the second printer 200. Additionally, the intermediate apparatus forms a loop to hold the continuous paper P, and varies a loop amount of the continuous paper P, thereby to absorb a difference of the path length setting value L (for example, 39 inches) caused by the paper length of one page allocated according to the image data length.

However, there is a limit of the difference of the paper amount absorbable by the intermediate apparatus having the buffer function. Additionally, when the difference of the paper amount (a variation range of the path length setting value L) becomes larger, the loop amount in the intermediate apparatus needs to be increased to raise the held amount of the continuous paper P. This leads to an increase in size of the intermediate apparatus, and thereby leads to a problem such as requirement of larger installation space and an increase of manufacturing cost. Moreover, when the intermediate apparatus is designed, determination of the difference of the paper amount is needed on the assumption that various image data lengths will be used. In addition, it is necessary to check whether a tolerance of the determined difference of the paper amount does not actually cause a problem. Furthermore, it is also necessary to accurately monitor whether the path length setting value L is controlled within the tolerance in the intermediate apparatus when the image forming system 1 operates.

In consideration of the above, the image forming system 1 according to the present exemplary embodiment controls (adjusts) the continuous paper transportation amount that is set in at least any one of the pre-transportation period T1 and the post-transportation period (T3+T4+T5), corresponding to the paper length of one page allocated according to the image data length, and thereby sets, to a predetermined paper amount, the path length setting value L at the time when the image formation processing is interrupted or the image formation is finished. With this operation, the image forming system 1 according to the present exemplary embodiment reduces a variation amount of the path length setting value L after the image formation is interrupted or finished.

This operation gives a smaller range of a variation of the path length setting value L that the intermediate apparatus, for example, needs to absorb after the image formation is interrupted or finished. Additionally, this operation gives a larger tolerance for the variation of the path length setting value L in the intermediate apparatus, even when various image data lengths are used. Thereby, the degree of freedom in designing the intermediate apparatus is increased, and downsizing is easily achieved. Additionally, the necessity to rigidly check whether a problem does not actually occur within the tolerance of the determined path length setting value L is reduced. Moreover, the necessity to set accuracy higher for monitoring whether the path length setting value L is controlled within the tolerance in the intermediate apparatus when the image forming system 1 operates is also reduced. Furthermore, the intermediate apparatus does not need a buffer function any more in some cases, which makes the installation space smaller and the manufacturing cost lower.

Note that the above-mentioned "path length setting value L" in this specification indicates a paper amount of the continuous paper P that actually exists on the transportation route from the arrangement position of the transfer roll 35 of the first printer 100 to that of the transfer roll 35 of the second printer 200 when the image forming system 1 operates. In contrast, "the defined paper amount" in this specification indicates a paper amount of the continuous paper P to be set on the transportation route from the arrangement position of the transfer roll 35 of the first printer 100 to that of the transfer roll 35 of the second printer 200 when the first printer 100 and the second printer 200 are arranged. This "defined paper amount" is prestored in the control computer 600. Additionally, "a user-set paper amount" to be described later is an amount obtained by a user adjusting "the path length setting value L" (for example, the defined paper amount) in accordance with properties and the like of the continuous paper P to be used, for example, and indicates an amount that is experimentally set as "the path length setting value L" appropriate for the user. This "user-set paper amount" is set by a user through the control computer 600, for example.

Description of Transportation Control in Second Printer

Next, a description is given of contents of control at the time when the transportation of the continuous paper P is controlled by adjustment of the continuous paper transportation amount that is set in at least any one of the pre-transportation period and the post-transportation period, corresponding to the paper length of one page allocated according to the image data length.

First, a description is given of the transportation control, concerning the continuous paper P, performed in the second printer 200.

Figures 1, 6:
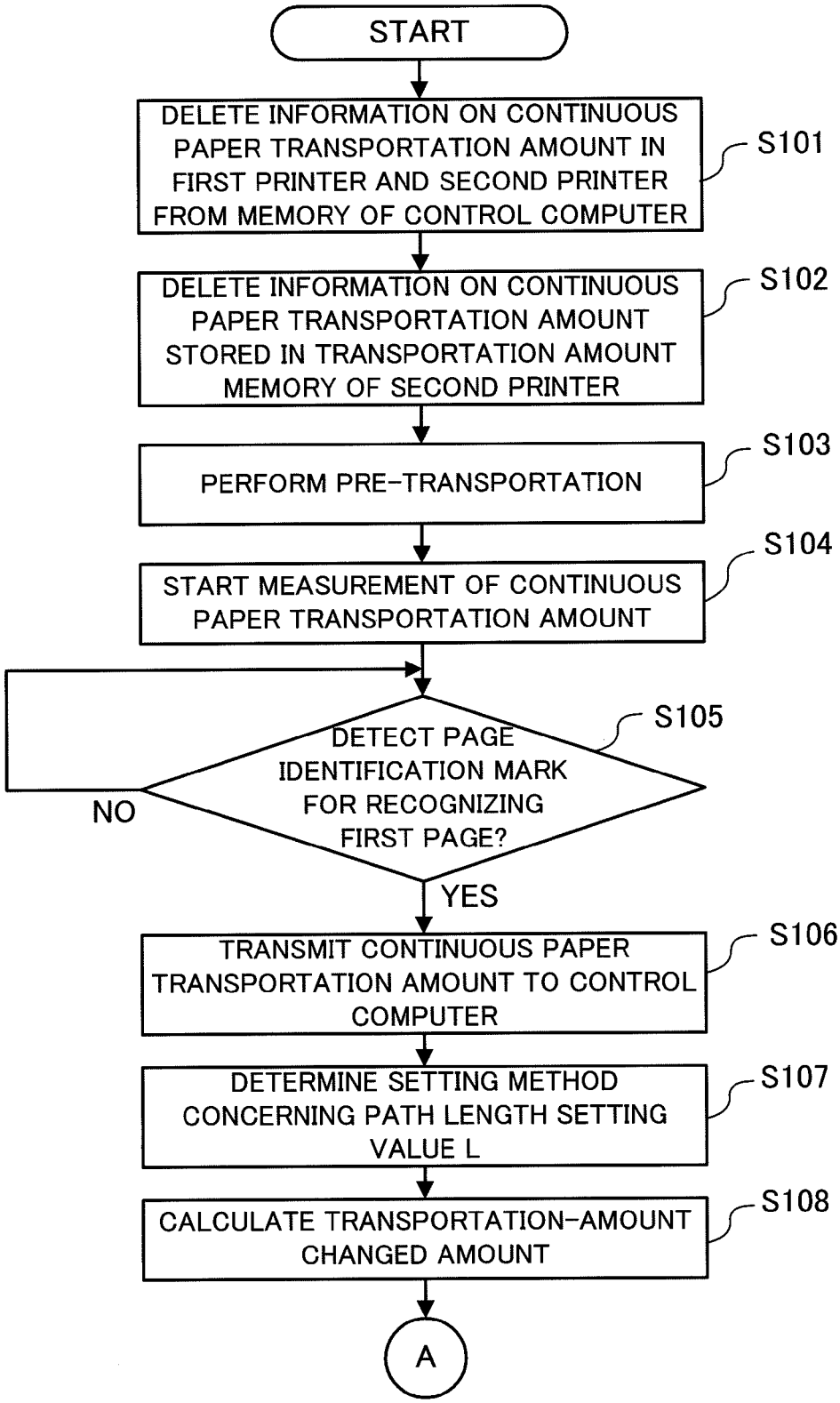
Figures 2, 6:
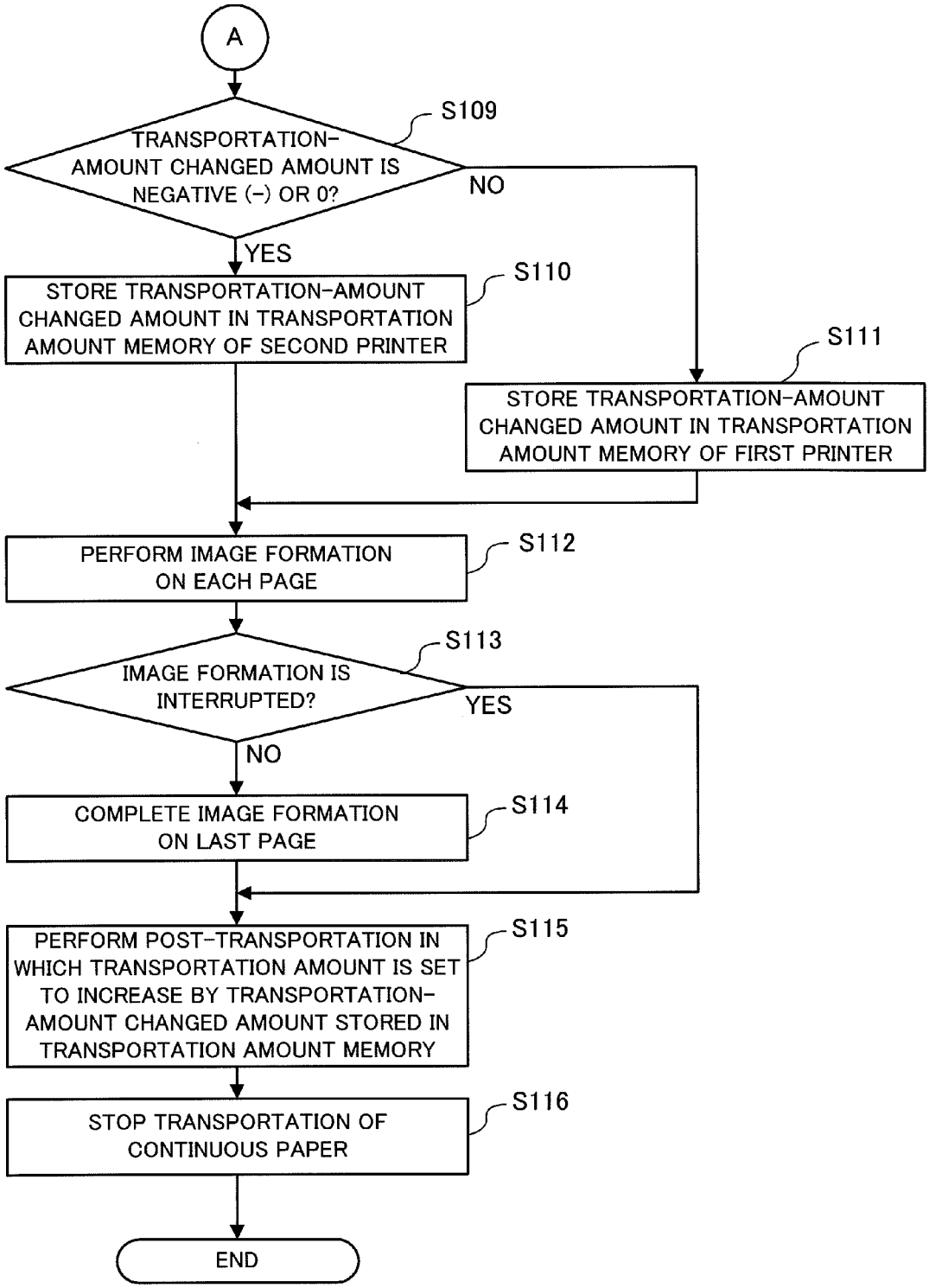

FIGS. 6-1 and 6-2 are flowcharts showing contents of the transportation control, concerning the continuous paper P, performed in the second printer 200.

As shown in FIG. 6-1, when the image formation processing in the image forming system 1 is started, the operation controller 601 in the control computer 600 (see FIG. 4) deletes, from the memory 603, information on the transportation amount of the continuous paper P in each of the first printer 100 and the second printer 200 (Step 101). Additionally, the second printer operation control part 51B of the second printer 200 deletes information on the transportation amount of the continuous paper P stored in the transportation amount memory 54B (Step 102). Note that, if the start of the image formation processing in the image forming system 1 is restart after interruption, processing of Steps 101 and 102 is not performed.

Subsequently, the printer controller 50B of the second printer 200 (the second printer operation control part 51B) controls the motor control part 52B and causes the motor control part 52B to perform the pre-transportation (see FIG. 5) (Step 103). Furthermore, the second printer operation control part 51B causes the transportation amount measuring part 53B to start measurement of the transportation amount of the continuous paper P (Step 104), and monitors the image reading sensor 37 to detect the page identification mark (ID_0: see FIG. 3) for recognizing the first page formed by the first printer 100 (No in Step 105).

When the image reading sensor 37 detects the page identification mark (ID_0) for recognizing the first page formed by the first printer 100 (Yes in Step 105), the second printer operation control part 51B transmits, to the control computer 600 through the communication network 700, the transportation amount of the continuous paper P that the transportation amount measuring part 53B has measured before the image reading sensor 37 detects the page identification mark (ID_0) (Step 106). The transportation amount of the continuous paper P transmitted to the control computer 600 herein is the paper amount of the continuous paper P that actually exists on the transportation route from the arrangement position of the transfer roll 35 of the first printer 100 to that of the transfer roll 35 of the second printer 200, namely, "the path length setting value L."

Next, the control computer 600 determines which one of the following is selected: the path length setting value L at the time when the image formation processing is stopped is set to "the defined paper amount" set in advance between the first printer 100 and the second printer 200; or the path length setting value L at the time when the image formation processing is stopped is set to "the user-set paper amount" set by a user in accordance with properties and the like of the continuous paper P to be used. That is, through the control computer 600, for example, the user is able to select any one of the following: the defined paper amount is used as the path length setting value L; and the user-set paper amount that is set by the user based on his/her experience is used as the path length setting value L. The control computer 600 determines, on the basis of setting information on the path length setting value L selected by the user, which one of the following the setting method concerning the path length setting value L is: the defined paper amount is set as the path length setting value L; and the user-set paper amount is set as the path length setting value L (Step 107).

The control computer 600 then calculates a difference (hereinafter, referred to as "a transportation-amount changed amount") between the transportation amount of the continuous paper P (the path length setting value L) transmitted from the printer controller 50B of the second printer 200 (the second printer operation control part 51B), and the defined paper amount or the user-set paper amount, by using the setting method concerning the path length setting value L determined in Step 107 (Step 108).

If the setting method using the defined paper amount as the path length setting value L is selected, the control computer 600 may calculate the transportation-amount changed amount by using the prestored defined paper amount and the path length setting value L at the time when the image forming system 1 operates, the latter of which is recognizable from the paper length allocated to one page according to the image data length. However, a more accurate transportation-amount changed amount is calculated by using the transportation amount of the continuous paper P that the transportation amount measuring part 53B has measured before the image reading sensor 37 detects the page identification mark (ID_0). This leads to more accurate setting of the path length setting value L at the time when the image formation processing is interrupted or the image formation is finished.

Subsequently, as shown in FIG. 6-2, if the calculated transportation-amount changed amount is negative (−) or 0 (Yes in Step 109), the path length setting value L is shorter than or equal to the defined paper amount or the user-set paper amount. This requires control to lengthen the path length setting value L or to maintain the path length setting value L as it is (at a defined value or a designed value). Accordingly, the control computer 600 transmits the transportation-amount changed amount calculated in Step 108 to the printer controller 50B of the second printer 200 through the communication network 700, and causes the transportation amount memory 54B of the printer controller 50B to store the transportation-amount changed amount (Step 110).

On the other hand, if the calculated transportation-amount changed amount is positive (+) (No in Step 109), the path length setting value L is longer than the defined paper amount or the user-set paper amount. This requires control to shorten the path length setting value L. Accordingly, the control computer 600 transmits the transportation-amount changed amount calculated in Step 108 to the first printer 100 through the communication network 700, and causes the transportation amount memory 54A of the printer controller 50A to store the transportation-amount changed amount (Step 111).

Note that, if the start of the image formation processing in the image forming system 1 is restart after interruption, processing of Steps 104 to 111 is not performed.

After that, the image formation is performed on each page of the continuous paper P (Step 112). If the image formation on each page of the continuous paper P is not interrupted (No in Step 113), the image formation on the last page is completed (Step 114). Then, the printer controller 50B (the second printer operation control part 51B) controls the motor control part 52B and causes the motor control part 52B to perform the post-transportation (see FIG. 5) in which the transportation amount is set so as to increase by the transportation-amount changed amount stored in the transportation amount memory 54B (Step 115). The second printer operation control part 51B then stops transportation of the continuous paper P when the post-transportation is finished (Step 116).

On the other hand, if the image formation on each page of the continuous paper P is interrupted during an operation, such as the image formation on each page of the continuous paper P (Yes in Step 113), then the printer controller 50B (the second printer operation control part 51B) immediately controls the motor control part 52B and causes the motor control part 52B to perform the post-transportation in which the transportation amount is set so as to increase by the transportation-amount changed amount stored in the transportation amount memory 54B (Step 115).

Note that, if the pre-transportation performed in Step 103 is performed after the image formation on each page of the continuous paper P is interrupted, the printer controller 50B (the second printer operation control part 51B) controls the motor control part 52B and causes the motor control part 52B to perform the pre-transportation (see FIG. 5) in which the transportation amount is set so as to increase by the transportation-amount changed amount stored in the transportation amount memory 54B. That is, since the post-transportation in Step 114 is performed in such a manner that the transportation amount is set so as to increase by the transportation-amount changed amount stored in the transportation amount memory 54B, transporting the continuous paper P more by the transportation-amount changed amount in the post-transportation leads to restart of the image formation from the position at which the interruption has occurred.

Description of Transportation Control in First Printer

Next, a description is given of the transportation control, concerning the continuous paper P, performed in the first printer 100.

Figure 7:
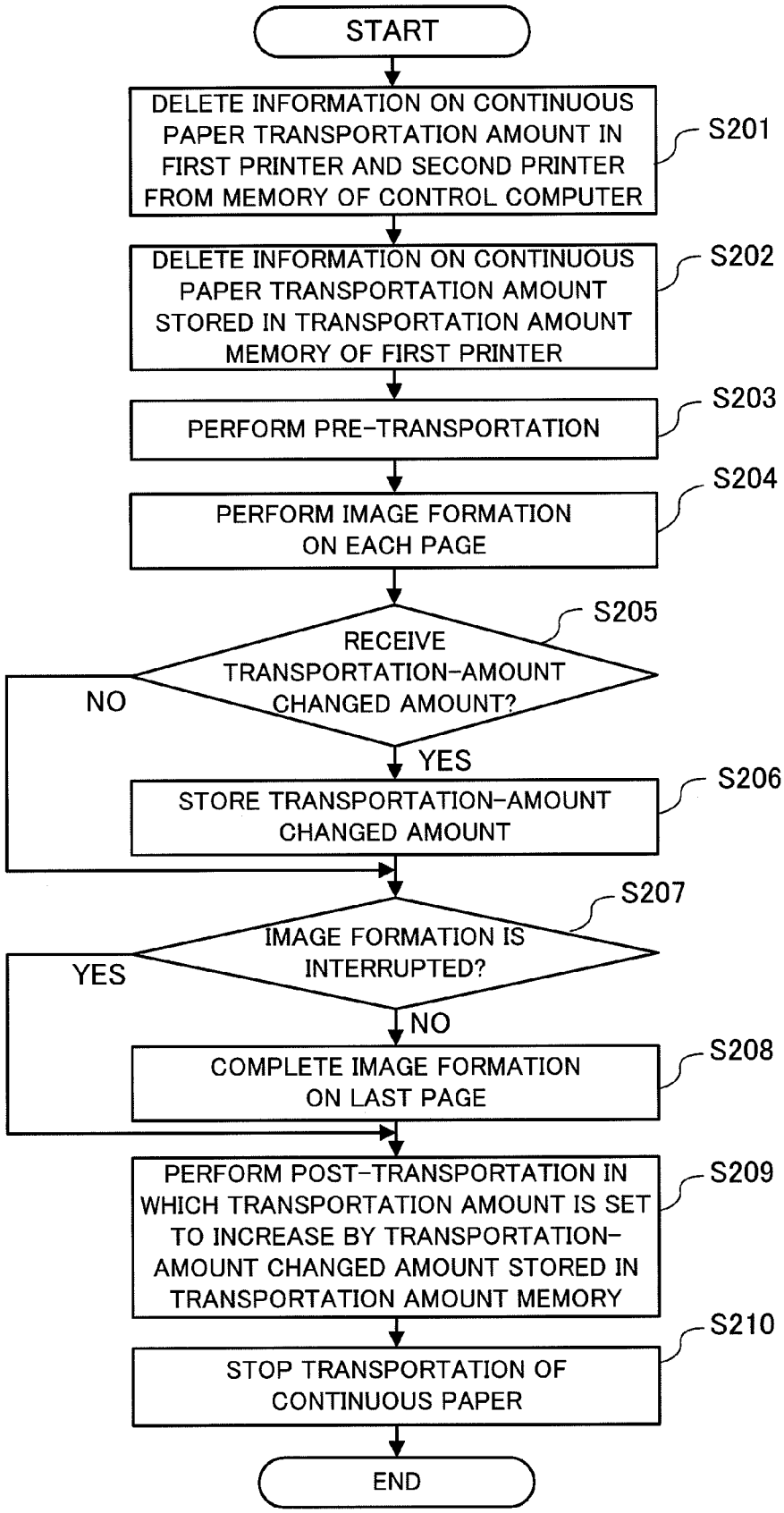
FIG. 7 is a flowchart showing contents of the transportation control, concerning the continuous paper, performed in the first printer.

FIG. 7 is a flowchart showing contents of the transportation control, concerning the continuous paper P, performed in the first printer 100.

As shown in FIG. 7, when the image formation processing in the image forming system 1 is started, the operation controller 601 in the control computer 600 deletes, from the memory 603, information on the transportation amount of the continuous paper P in each of the first printer 100 and the second printer 200 (Step 201). Additionally, the first printer operation control part 51A of the first printer 100 deletes information on the transportation amount of the continuous paper P stored in the transportation amount memory 54A (Step 202). Note that, if the start of the image formation processing in the image forming system 1 is restart after interruption, processing of Steps 201 and 202 is not performed.

Subsequently, the printer controller 50A of the first printer 100 (the first printer operation control part 51A) controls the motor control part 52A and causes the motor control part 52A to perform the pre-transportation (see FIG. 5) (Step 203). The pre-transportation herein is performed by using the transportation amount adjusted with the transportation-amount changed amount stored in the transportation amount memory 54A.

After that, the image formation is performed on each page of the continuous paper P (Step 204). If receiving the transportation-amount changed amount from the control computer 600 through the communication network 700 (Yes in Step 205), the first printer operation control part 51A causes the transportation amount memory 54A to store the received transportation-amount changed amount (Step 206). If the image formation on each page of the continuous paper P is not interrupted (No in Step 207), the image formation on the last page is completed (Step 208). Then, the printer controller 50A (the first printer operation control part 51A) controls the motor control part 52A and causes the motor control part 52A to perform the post-transportation (see FIG. 5) in which the transportation amount is set so as to increase by the transportation-amount changed amount stored in the transportation amount memory 54A (Step 209). The first printer operation control part 51A then stops transportation of the continuous paper P when the post-transportation is finished (Step 210).

On the other hand, if the image formation on each page of the continuous paper P is interrupted during an operation, such as the image formation on each page of the continuous paper P (Yes in Step 207), then the printer controller 50A (the first printer operation control part 51A) immediately controls the motor control part 52A and causes the motor control part 52A to perform the post-transportation in which the transportation amount is set so as to increase by the transportation-amount changed amount stored in the transportation amount memory 54A (Step 209).

Description of Transportation-Amount Changed Amount

Here, a specific description is given of the transportation-amount changed amount calculated in Step 108 of FIG. 6-1.

First, a description is given of a case where the setting method concerning the path length setting value L selected in Step 107 of FIG. 6-1 is to use the defined paper amount as the path length setting value L, for example.

As described above, the path length setting value L is a paper amount of the continuous paper P that actually exists on the transportation route from the arrangement position of the transfer roll 35 of the first printer 100 to that of the transfer roll 35 of the second printer 200 when the image forming system 1 operates. Additionally, the path length setting value L is generally a paper amount that is an integral multiple of the paper length (the length of an image region and a margin) allocated to one page according to the image data length. The minimum paper amount exceeding the defined paper amount is set as the path length setting value L. Accordingly, if the setting method setting the defined paper amount as the path length setting value L is used, a positive (+) difference obtained by subtracting the defined paper amount from the path length setting value L (paper amount×N (N: integer)) is calculated as the transportation-amount changed amount for adjusting the path length setting value L at the time when the image formation processing is interrupted or the image formation is finished.

In this case, since the path length setting value L is adjusted to be shorter so that the paper amount becomes the defined paper amount when the image formation processing is interrupted or the image formation is finished, the transportation amount of the pre-transportation and the post-transportation in the first printer 100 on the upstream side is increased by the transportation-amount changed amount.

Figure 8:
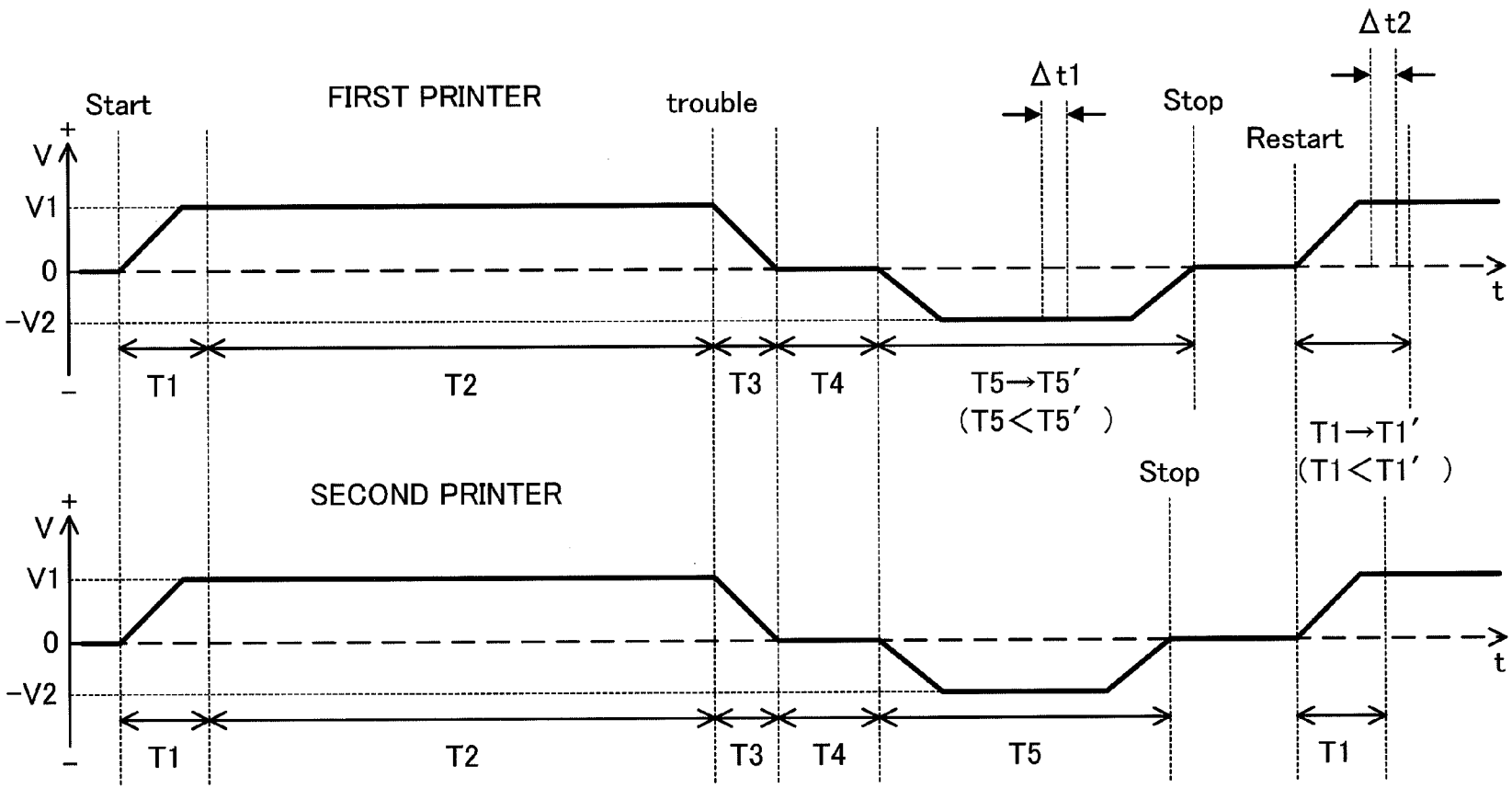
FIG. 8 is a diagram illustrating the transportation sequence in which the transportation amount of the pre-transportation and the post-transportation in the first printer is increased by the transportation-amount changed amount.

FIG. 8 is a diagram illustrating the transportation sequence in which the transportation amount of the pre-transportation and the post-transportation in the first printer 100 is increased by the transportation-amount changed amount.

In the transportation sequence shown in FIG. 8, the period T5 of the backward period, during which the first printer 100 makes the continuous paper P go back at the transportation speed (−V2), in the post-transportation period (T3+T4+T5) is set to a period T5' (>T5) lengthened by a period·t1 so that the transportation amount increases by the transportation-amount changed amount. Thereby, the path length setting value L is adjusted so as to be longer than the present path length setting value L by the transportation-amount changed amount.

As a result, the return amount of the continuous paper P on the transportation route from the arrangement position of the transfer roll 35 of the first printer 100 to that of the transfer roll 35 of the second printer 200 is increased. Accordingly, when the next image formation processing is started or restarted, the pre-transportation period T1 of the forward period, during which the first printer 100 makes the continuous paper P go forward at the transportation speed V1, is set to a period T1' (>T1) lengthened by a period·t2 so that the transportation amount increases by the transportation-amount changed amount.

Thereby, when the image formation processing is started or restarted, the image formation is started again from the position at which the stop or interruption has occurred. This reduces occurrence of a problem, such as missing of images before and after the interruption, and generating a wasteful part of paper due to performing new image formation again from the head of a page.

Note that, if the difference obtained by subtracting the defined paper amount from the path length setting value L is regarded as almost 0, the transportation amount of the pre-transportation and the post-transportation in the first printer 100 may be set to the defined amount (the designed amount).

Next, a description is given of a case where the setting method concerning the path length setting value L selected in Step 107 of FIG. 6-1 is to use the user-set paper amount as the path length setting value L, for example.

For example, if the path length setting value L is adjusted to a path length setting value L that is increased or decreased as compared with the defined paper amount by a user, the path length setting value L set at the time when the image formation processing is interrupted or the image formation is finished is also adjusted so as to lengthen or shorten by an amount increased or decreased by the user. For this reason, for example, if the path length setting value L is adjusted to a path length setting value L that is increased as compared with the defined paper amount by a user, the transportation amount of the pre-transportation and the post-transportation in the second printer 200 on the downstream side is increased by the increased amount, and is set to the path length setting value L increased as compared with the defined paper amount. Note that the transportation-amount changed amount in this case is given as "path length setting value L in operation (paper amount×N (N: integer))−defined paper amount+increase by user."

Figure 9:
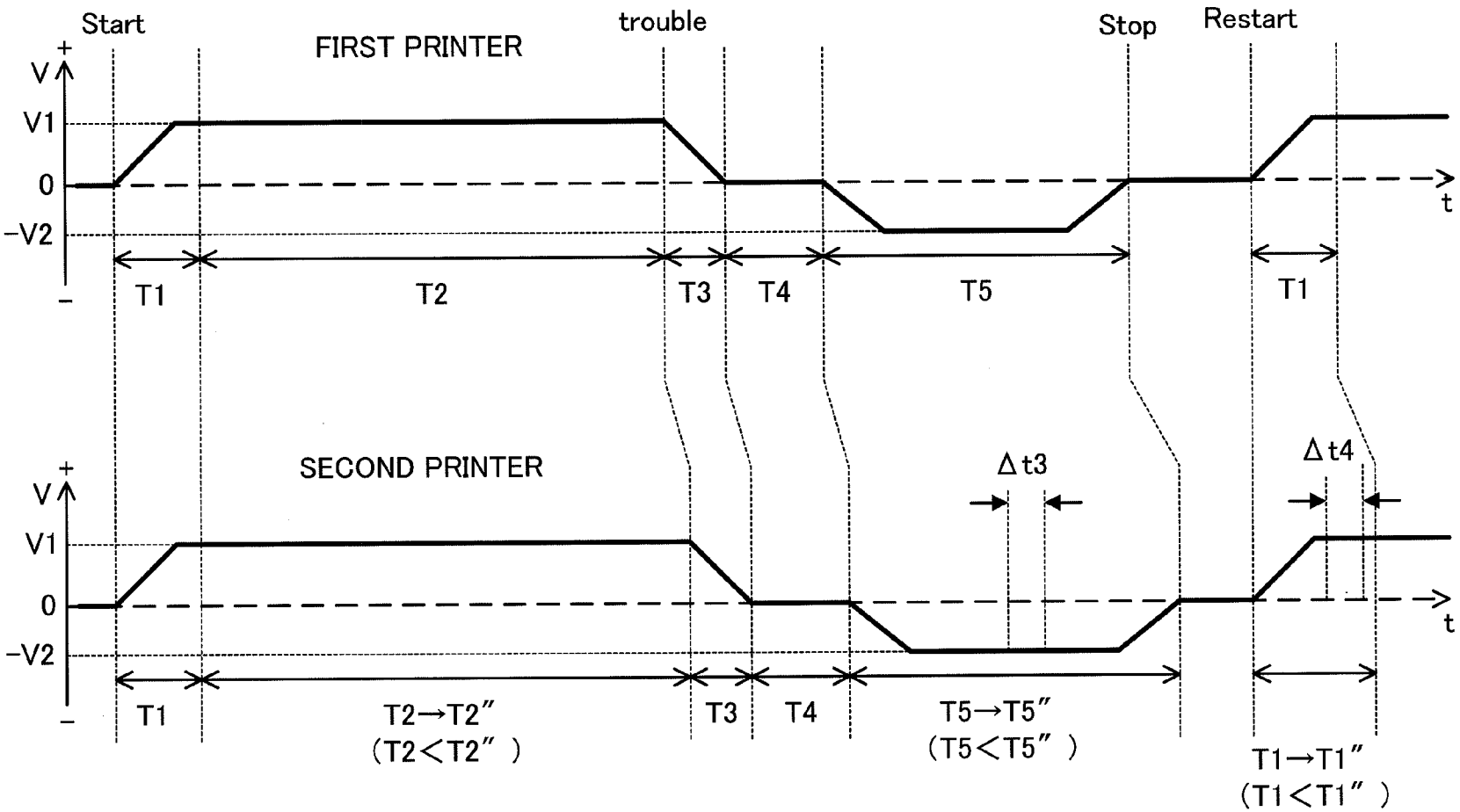
FIG. 9 is a diagram illustrating the transportation sequence in which the transportation amount of the pre-transportation and the post-transportation in the second printer is increased by the transportation-amount changed amount.

FIG. 9 is a diagram illustrating the transportation sequence in which the transportation amount of the pre-transportation and the post-transportation in the second printer 200 is increased by the transportation-amount changed amount.

In the transportation sequence shown in FIG. 9, the period T5 of the backward period, during which the second printer 200 makes the continuous paper P go back at the transportation speed (−V2), in the post-transportation period (T3+T4+T5) is set to a period T5" (>T5) lengthened by a period·t3 so that the transportation amount increases by the transportation-amount changed amount. Thereby, the path length setting value L is adjusted so as to be longer than the defined paper amount by the transportation-amount changed amount.

As a result, the return amount of the continuous paper P on the transportation route from the arrangement position of the transfer roll 35 of the first printer 100 to that of the transfer roll 35 of the second printer 200 is increased. Accordingly, when the next image formation processing is started or restarted, the pre-transportation period T1 of the forward period, during which the second printer 200 makes the continuous paper P go forward at the transportation speed V1, is set to a period T1" (>T1) lengthened by a period·t4 so that the transportation amount increases by the transportation-amount changed amount.

Thereby, when the image formation processing is started or restarted, the image formation is started again from the position at which the stop or interruption has occurred. This reduces occurrence of a problem, such as missing of images before and after the interruption, and generating a wasteful part of paper due to performing new image formation again from the head of a page.

Note that, if the adjusted amount (the amount of increase or decrease) by a user is smaller than a predetermined amount, the transportation-amount changed amount of the pre-transportation and the post-transportation in the second printer 200 may be set to 0 and the transportation amount may be uniformly set to the defined paper amount.

Here, if the path length setting value L is adjusted to a path length setting value L that is increased as compared with an paper amount of an integral multiple of the paper length by a user, the timing shown in Step 105 of FIG. 6-1 at which the page identification mark (ID_0) is detected in the second printer 200 on the downstream side is delayed. Thus, the period T2 of the image formation period becomes a longer period T2" (>T2) by a period corresponding to the delay of the detection timing of the page identification mark (ID_0).

On the other hand, if the path length setting value L is adjusted to a path length setting value L that is decreased as compared with the defined paper amount by a user, the transportation amount of the pre-transportation and the post-transportation in the first printer 100 on the upstream side is increased by the decreased amount, and is set to the path length setting value L decreased as compared with the defined paper amount. Note that the transportation-amount changed amount in this case is given as "path length setting value L in operation (paper amount×N (N: integer))−defined paper amount+decrease by user."

In this case, although values of the transportation-amount changed amount are different, the transportation amount of the pre-transportation and the post-transportation in the first printer 100 is adjusted by the transportation-amount changed amount, similarly to the transportation sequence shown in FIG. 8 described above.

Note that, if the path length setting value L is adjusted to a path length setting value L that is decreased as compared with the defined paper amount by a user, the timing shown in Step 105 of FIG. 6-1 at which the page identification mark (ID_0) is detected in the second printer 200 on the downstream side is advanced, unlike the transportation sequence shown in FIG. 9. Thus, the period T2 of the image formation period in the second printer 200 on the downstream side becomes a shorter period T2" (<T2) by a period corresponding to the advance of the detection timing of the page identification mark (ID_0).

If the user-set paper amount adjusted by a user is used as the path length setting value L, the timing at which the image formation period finishes is different between the first printer 100 and the second printer 200 as the transportation sequence shown in FIG. 9, depending on the timing shown in Step 105 of FIG. 6-1 at which the page identification mark (ID_0) is detected. Thus, when the post-transportation is performed, the stop timing of going forward (for example, the start time points of the period T4 in FIG. 9) and the start timing of going backward (for example, the start time points of the periods T5 and T5" in FIG. 9) of the first printer 100 and the second printer 200 do not coincide with each other. This might apply an accidental load to the continuous paper P.

For this reason, the first printer 100 and the second printer 200 may be configured to adjust the transportation amount in the image formation period (the period T2) as well as the periods of the pre-transportation and the post-transportation, so that the stop timing of going forward (the start time points of the period T4) and the start timing of going backward (the start time points of the periods T5 and T5") of the first printer 100 and the second printer 200 in the post-transportation coincide with each other.

Figure 10:
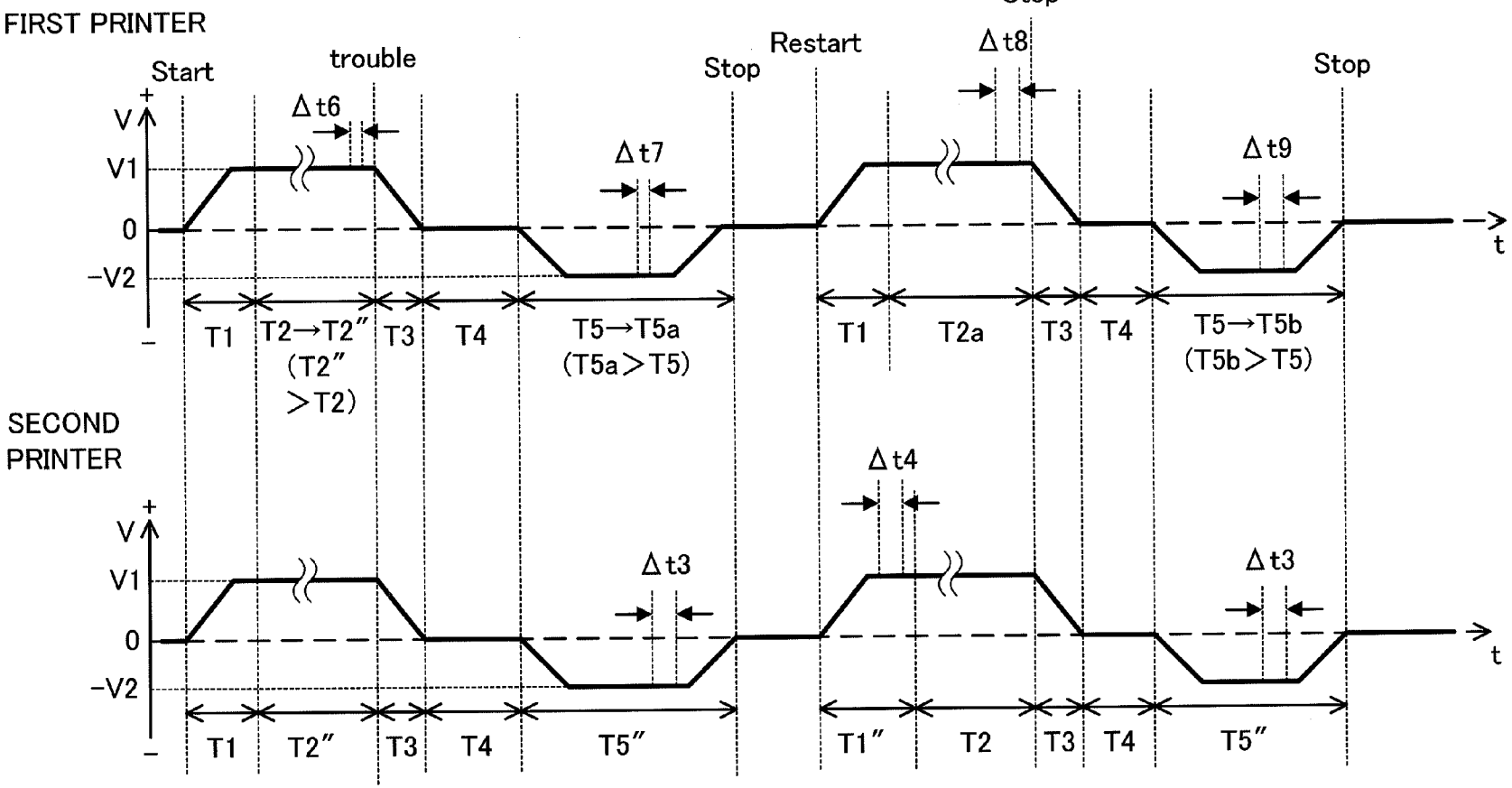
FIG. 10 is a diagram showing an example of the transportation sequence adjusted so that the stop timing of going forward and the start timing of going backward in the post-transportation performed by the first printer and the second printer coincide with each other.

FIG. 10 is a diagram showing an example of the transportation sequence adjusted so that the stop timing of going forward and the start timing of going backward in the post-transportation performed by the first printer 100 and the second printer 200 coincide with each other.

As shown in FIG. 10, for example, in accordance with the image formation period of the second printer 200 changed to the longer period T2" (>T2) by a period corresponding to the delay of the detection timing of the page identification mark (ID_0), the image formation period of the first printer 100 is lengthened by a period·t6 and is set to the period T2". This causes the timing at which the image formation period (the period T2") finishes to coincide. Thus, the stop timing of going forward (the start time points of the period T4) and the start timing of going backward (the start time points of a period T5*a* and the period T5") of the first printer 100 and the second printer 200 in the post-transportation coincide with each other.

Here, lengthening the image formation period of the first printer 100 by the period·t6 to adjust the image formation period to the period T2" increases the transportation amount of the continuous paper P in the first printer 100. Accordingly, the backward period of the post-transportation in the first printer 100 is set to the period T5*a* (>T5) lengthened by a period·t7, in order to return, in the opposite direction, the continuous paper P for the transportation amount increased by lengthening the image formation period by the period·t6.

Additionally, after the image formation processing is restarted (Restart), also in the first printer 100, the image formation period is lengthened by a period·t8, in accordance with the pre-transportation period T1 of the forward period in the second printer 200 being set to the period T1" (>T1) lengthened by the period·t4 so that the transportation amount increases by the transportation-amount changed amount. This causes the timing at which the image formation periods (the period T2 and a period T2*a*) finish to coincide. Thus, the stop timing of going forward (the start time points of the period T4) and the start timing of going backward (the start time points of a period T5*b* and the period T5") of the first printer 100 and the second printer 200 in the post-transportation coincide with each other.

Note that, lengthening the image formation period of the first printer 100 by the period·t8 increases the transportation amount of the continuous paper P in the first printer 100. Accordingly, the backward period of the post-transportation in the first printer 100 is set to the period T5*b* (>T5) lengthened by a period·t9, in order to return, in the opposite direction, the continuous paper P for the transportation amount increased by lengthening the image formation period by the period·t8.

Thereby, even when the image formation processing is restarted (Restart), the stop timing of going forward (the start time points of the period T4) and the start timing of going backward (the start time points of the periods T5*b* and T5") of the first printer 100 and the second printer 200 in the post-transportation coincide with each other. This inhibits an accidental load from applying to the continuous paper P.

As described above, by adjusting the transportation amount of the continuous paper P in the image formation period as well as the transportation amount of the pre-transportation and the post-transportation in any one of the first printer 100 and the second printer 200, the path length setting value L at the time when the image formation processing is interrupted or the image formation is finished is adjusted, while an accidental load is inhibited from applying to the continuous paper P.

Additionally, by adjusting the transportation amount of the pre-transportation and the post-transportation in both of the first printer 100 and the second printer 200, the path length setting value L at the time when the image formation processing is interrupted or the image formation is finished is adjusted, while an accidental load is inhibited from applying to the continuous paper P.

As has been described above, the image forming system 1 according to the present exemplary embodiment controls the continuous paper transportation amount that is set in at least any one of the pre-transportation period and the post-transportation period, corresponding to the paper length of one page allocated according to the image data length, and thereby sets, to a predetermined paper amount, the path length setting value L at the time when the image formation processing is interrupted or the image formation is finished. With this operation, the image forming system 1 according to the present exemplary embodiment reduces a variation amount of the path length setting value L after the image formation is interrupted or finished.

The image forming system 1 according to the present exemplary embodiment has such a configuration that the control computer 600 controlling the operations of the first printer 100 and the second printer 200 is arranged separately from the first printer 100 and the second printer 200. Instead of this configuration, the control computer 600 may be configured so as to be arranged inside of any one of the first printer 100 and the second printer 200. Additionally, the printer controller 50A of the first printer 100 or the printer controller 50B of the second printer 200 may be configured so as to have the function of the control computer 600.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

a first image forming unit that forms an image on a first surface of a recording medium formed into a belt shape;

a second image forming unit that is arranged on a downstream side with respect to the first image forming unit in a transporting direction of the recording medium, and that forms an image on a second surface of the recording medium while transporting the recording medium spanning the first image forming unit and the second image forming unit;

a first transportation controller that controls a transportation operation of the recording medium including a pre-transportation operation and a post-transportation operation in the first image forming unit, the pre-transportation operation being performed from a transportation start of the recording medium to a time point after arrival at a predetermined transportation speed, the post-transportation operation including return transportation of the recording medium to an upstream side in the transporting direction performed from a start of a transportation stop to a stop of the recording medium;

a second transportation controller that controls a transportation operation of the recording medium including a pre-transportation operation and a post-transportation operation in the second image forming unit, the pre-transportation operation being performed from a transportation start of the recording medium to a time point after arrival at a predetermined transportation speed, the post-transportation operation including return transportation of the recording medium to the upstream side in the transporting direction performed from a start of a transportation stop to a stop of the recording medium; and a transportation amount adjusting unit that adjusts at least any one of a transportation amount of the recording medium in the pre-transportation operation and the post-transportation operation controlled by the first transportation controller and a transportation amount of the recording medium in the pre-transportation operation and the post-transportation operation controlled by the second transportation controller, wherein, the transportation amount adjusting unit includes:

a first recording medium amount calculation unit that calculates a first recording medium amount, the first recording medium amount being actually present between the first image forming unit and the second image forming unit at a start of transportation;

a second recording medium amount memory that stores a second recording medium amount, the second recording medium amount being predetermined to be an integral multiple of a paper length defined in a running job; and a transportation-amount changed amount calculation unit that calculates a transportation-amount changed amount, the transportation-amount changed amount being calculated by subtracting the second recording medium amount stored in the second recording medium amount memory from the first recording medium amount calculated by the first recording medium amount calculation unit, wherein the transportation amount adjusting unit adjusts the transportation amount on the basis of the transportation-amount changed amount calculated by the transportation-amount changed amount calculation unit so that recording medium amount actually present between the first image forming unit and the second image forming unit during an image formation corresponds to the second recording medium amount.

2. The image forming system according to claim 1, wherein the first transportation controller performs control so that the transportation amount of the recording medium in the post-transportation operation to the upstream side in the transporting direction coincides with the transportation amount of the recording medium in the pre-transportation operation to the downstream side in the transporting direction, and the second transportation controller performs control so that the transportation amount of the recording medium in the post-transportation operation to the upstream side in the transporting direction coincides with the transportation amount of the recording medium in the pre-transportation operation to the downstream side in the transporting direction.

3. The image forming system according to claim 1, further comprising a transportation amount measuring unit that measures the recording medium amount existing between the first image forming unit and the second image forming unit, wherein the recording medium amount setting unit adjusts at least any one of the transportation amount of the recording medium in the pre-transportation operation and the post-transportation operation controlled by the first transportation controller and the transportation amount of the recording medium in the pre-transportation operation and the post-transportation operation controlled by the second transportation controller, in accordance with the recording medium amount measured by the transportation amount measuring unit.

4. An image forming system comprising:

a first image forming unit that forms an image on a first surface of a recording medium formed into a belt shape;

a second image forming unit that is arranged on a downstream side with respect to the first image forming unit in a transporting direction of the recording medium, and that forms an image on a second surface of the recording medium while transporting the recording medium spanning the first image forming unit and the second image forming unit;

a first transportation controller that controls a post-transportation operation in the first image forming unit, the post-transportation operation including return transportation of the recording medium to an upstream side in the transporting direction performed from a start of a transportation stop to a stop of the recording medium;

a second transportation controller that controls a post-transportation operation in the second image forming unit, the post-transportation operation including return transportation of the recording medium to the upstream side in the transporting direction performed from a start of a transportation stop to a stop of the recording medium; and a transportation amount adjusting unit that adjusts at least any one of a transportation amount of the recording medium in the post-transportation operation controlled by the first transportation controller and a transportation amount of the recording medium in the post-transportation operation controlled by the second transportation controller, wherein the transportation amount adjusting unit includes:

a first recording medium amount calculation unit that calculates a first recording medium amount, the first recording medium amount being actually present between the first image forming unit and the second image forming unit at a start of transportation;

a second recording medium amount memory that stores a second recording medium amount, the second recording medium amount being predetermined to be an integral multiple of a paper length defined in a running job; and a transportation-amount changed amount calculation unit that calculates a transportation-amount changed amount, the transportation-amount changed amount being calculated by subtracting the second recording medium amount stored in the second recording medium amount memory from the first recording medium amount calculated by the first recording medium amount calculation unit, wherein the transportation amount adjusting unit adjusts the transportation amount on the basis of the transportation-amount changed amount calculated by the transportation-amount changed amount calculation unit so that a recording medium amount actually present between the first image forming unit and the second image forming unit during an image formation corresponds to the second recording medium amount.

5. The image forming system according to claim 4, wherein the recording medium amount setting unit further adjusts at least any one of a transportation amount of the recording medium on an occasion of image formation controlled by the first transportation controller and a transportation amount of the recording medium on an occasion of image formation controlled by the second transportation controller.

6. The image forming system according to claim 4, further comprising a reception unit that receives an instruction from a user, concerning the recording medium amount being set to exist between the first image forming unit and the second image forming unit by the recording medium amount setting unit.

7. The image forming system according to claim 4, wherein, if the transportation-amount changed amount calculated by the transportation-amount changed amount calculation unit is negative, the transportation amount adjusting unit adjusts the transportation amount in the post-transportation operation in the second image forming unit to increase by the transportation-amount changed amount so that the recording medium amount actually present between the first image forming unit and the second image forming unit during the image formation corresponds to the second recording medium amount, and if the transportation-amount changed amount calculated by the transportation-amount changed amount calculation unit is positive, the transportation amount adjusting unit adjusts the transportation amount in the post-transportation operation in the first image forming unit to increase by the transportation-amount changed amount so that the recording medium amount actually present between the first image forming unit and the second image forming unit during the image formation corresponds to the second recording medium amount.

* * * * *